US005877480A

United States Patent [19]

Tuso et al.

[11] Patent Number: 5,877,480

[45] Date of Patent: Mar. 2, 1999

[54] ILLUMINATING UMPIRE COUNTER AND TIMING DEVICE

[76] Inventors: Joseph A. Tuso; John Torian, both of 238 E. Mountain Ct., Brea, Calif. 92621

[21] Appl. No.: 695,130

[22] Filed: Aug. 8, 1996

[51] Int. Cl.[6] ..... G07G 1/00

[52] U.S. Cl. ..... 235/1 B; 235/1 C

[58] Field of Search ..... 235/487, 1 B, 235/1 C, 1 R; 340/323 R; 116/223, 225

[56] References Cited

U.S. PATENT DOCUMENTS

| | | | |
|---|---|---|---|
| D. 314,711 | 2/1991 | Cox | D10/46.1 |
| 4,072,125 | 2/1978 | Spalla | 116/223 |
| 4,173,197 | 11/1979 | Anker | 116/223 |
| 4,357,895 | 11/1982 | Nightingale | 116/225 |
| 4,637,732 | 1/1987 | Jones et al. | 368/109 |
| 5,084,695 | 1/1992 | Freeman | 340/323 R |

*Primary Examiner*—Anita Pellman Gross
*Assistant Examiner*—Karl D. Frech

[57] ABSTRACT

An illuminating umpire counter and timing device including a hand-held housing having three apertures through a top face thereof. Each of the apertures have distinguishable indicia adjacent thereto. Three indicating wheels are rotatably disposed and extending outwardly of side walls of the housing. The wheels has illuminated numbers disposed circumferentially thereon. The three wheels are positioned within the housing whereby the numbers selectively aligning with the three apertures of the housing. An illuminating digital watch/stopwatch is secured within the top face of the housing.

1 Claim, 3 Drawing Sheets

ILLUMINATING UMPIRE COUNTER AND TIMING DEVICE

BACKGROUND OF THE INVENTION

1. Field of the Invention

The present invention relates to an illuminating umpire counter and timing device and more particularly pertains to tracking pitches, outs and time during a ball game with an illuminating umpire counter and timing device.

2. Description of the Prior Art

The use of umpire counters is known in the prior art. More specifically, umpire counters heretofore devised and utilized for the purpose of counting balls and strikes are known to consist basically of familiar, expected and obvious structural configurations, notwithstanding the myriad of designs encompassed by the crowded prior art which have been developed for the fulfillment of countless objectives and requirements.

By way of example, U.S. Pat. No. 5,084,695 to Freeman discloses an umpire's counter.

U.S. Pat. No. 4,637,732 to Jones et al. discloses a hand held athletic officiating timers.

U.S. Pat. No. 4,072,125 to Spalla discloses an umpire's counter.

U.S. Pat. No. Des. 349,859 to Asano discloses the ornamental design for a score counter.

U.S. Pat. No. Des. 323,629 to Murphy discloses the ornamental design for a football score keeper.

U.S. Pat. No. Des. 314,711 to Cox discloses the ornamental design for a tennis score recorder.

While these devices fulfill their respective, particular objective and requirements, the aforementioned patents do not describe an illuminating umpire counter and timing device for tracking pitches, outs and time during a ball game.

In this respect, the illuminating umpire counter and timing device according to the present invention substantially departs from the conventional concepts and designs of the prior art, and in doing so provides an apparatus primarily developed for the purpose of tracking pitches, outs and time during a ball game.

Therefore, it can be appreciated that there exists a continuing need for new and improved illuminating umpire counter and timing device which can be used for tracking pitches, outs and time during a ball game. In this regard, the present invention substantially fulfills this need.

SUMMARY OF THE INVENTION

In the view of the foregoing disadvantages inherent in the known types of umpire counters now present in the prior art, the present invention provides an improved illuminating umpire counter and timing device. As such, the general purpose of the present invention, which will be described subsequently in greater detail, is to provide a new and improved illuminating umpire counter and timing device and method which has all the advantages of the prior art and none of the disadvantages.

To attain this, the present invention essentially comprises a hand-held housing having a top face, a bottom face and a surrounding side wall. The housing has a configuration dimensioned to fit in a palm of a hand. The top face has three apertures therethrough arranged in a triangular configuration. Each of the apertures has distinguishable indicia adjacent thereto. Three indicating wheels are rotatably disposed and extending outwardly of the surrounding side wall of the housing. Each of the wheels are rotatably coupled on a shaft. Each of the wheels has a plurality of notches disposed on a lower surface thereof. A spring plate is disposed within the housing for engagement with one of the plurality of notches. Two of the wheels have illuminated numbers 0–3 disposed circumferentially thereon. A last of the three wheels has illuminated numbers 0–4 disposed circumferentially thereon. The three wheels are positioned within the housing whereby the numbers selectively align with the three apertures of the housing. A battery is disposed within the housing inwardly of an access door on the bottom face of the housing. An illuminating digital watch/stopwatch is secured within the top face of the housing. The watch/stopwatch is electrically coupled with the battery. A control panel is secured within the top face of the housing. The control panel has buttons for controlling functions of the watch/stopwatch. The control panel is electrically coupled with the battery. An LED is secured within the top face of the housing. The LED is electrically coupled with a light button of the control panel whereby the light button selectively activates or deactivates the LED.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto.

In this respect, before explaining at least one embodiment of the invention in detail, it is to be understood that the invention is not limited in its application to the details of construction and to the arrangements of the components set forth in the following description or illustrated in the drawings. The invention is capable of other embodiments and of being practiced and carried out in various ways. Also, it is to be understood that the phraseology and terminology employed herein are for the purpose of description and should not be regarded as limiting.

As such, those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved illuminating umpire counter and timing device which has all the advantages of the prior art umpire counters and none of the disadvantages.

It is another object of the present invention to provide a new and improved illuminating umpire counter and timing device which may be easily and efficiently manufactured and marketed.

It is a further object of the present invention to provide a new and improved illuminating umpire counter and timing device which is of durable and reliable construction.

An even further object of the present invention is to provide a new and improved illuminating umpire counter and timing device which is susceptible of a low cost of manufacture with regard to both materials and labor, and which accordingly is then susceptible of low prices of sale to the consuming public, thereby making such an illuminating umpire counter and timing device economically available to the buying public.

Still yet another object of the present invention is to provide a new and improved illuminating umpire counter and timing device which provides in the apparatuses and methods of the prior art some of the advantages thereof, while simultaneously overcoming some of the disadvantages normally associated therewith.

Even still another object of the present invention is to provide a new and improved illuminating umpire counter and timing device for tracking pitches, outs and time during a ball game.

Lastly, it is an object of the present invention to provide a new and improved illuminating umpire counter and timing device including a hand-held housing having three apertures through a top face thereof. Each of the apertures have distinguishable indicia adjacent thereto. Three indicating wheels are rotatably disposed and extending outwardly of side walls of the housing. The wheels has illuminated numbers disposed circumferentially thereon. The three wheels are positioned within the housing whereby the numbers selectively aligning with the three apertures of the housing. An illuminating digital watch/stopwatch is secured within the top face of the housing.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

The same reference numerals refer to the same parts through the various Figures.

DESCRIPTION OF THE PREFERRED EMBODIMENT

Figure 1:
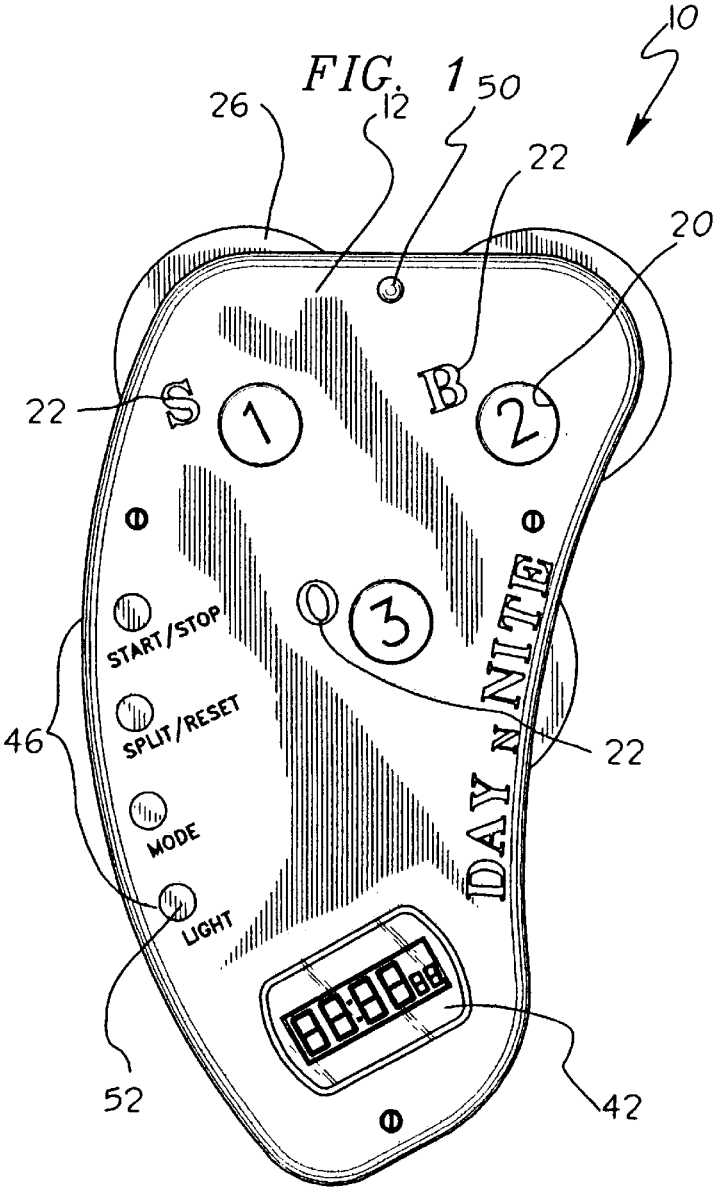
FIG. 1 is a perspective view of the preferred embodiment of the illuminating umpire counter and timing device constructed in accordance with the principles of the present invention.
Figure 2:
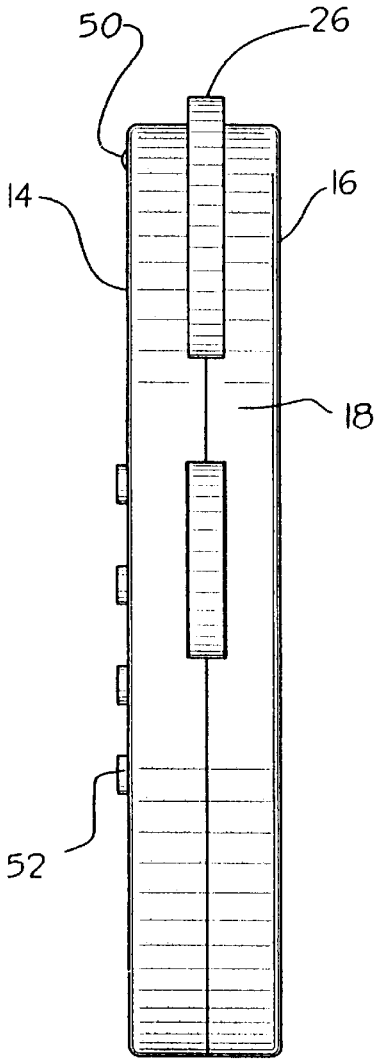
FIG. 2 is side view of the present invention shown in an upright orientation.
Figure 3:
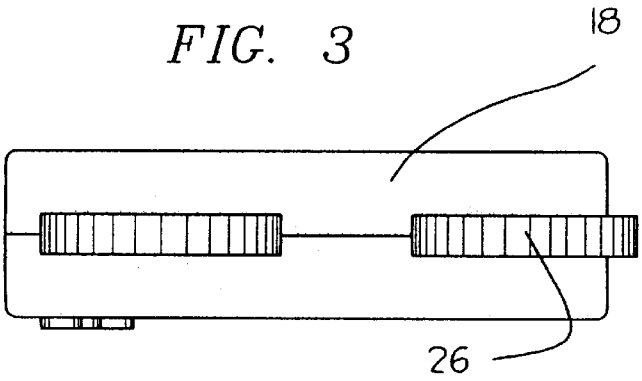
FIG. 3 is a plan view of the preferred embodiment of the present invention.
Figure 4:
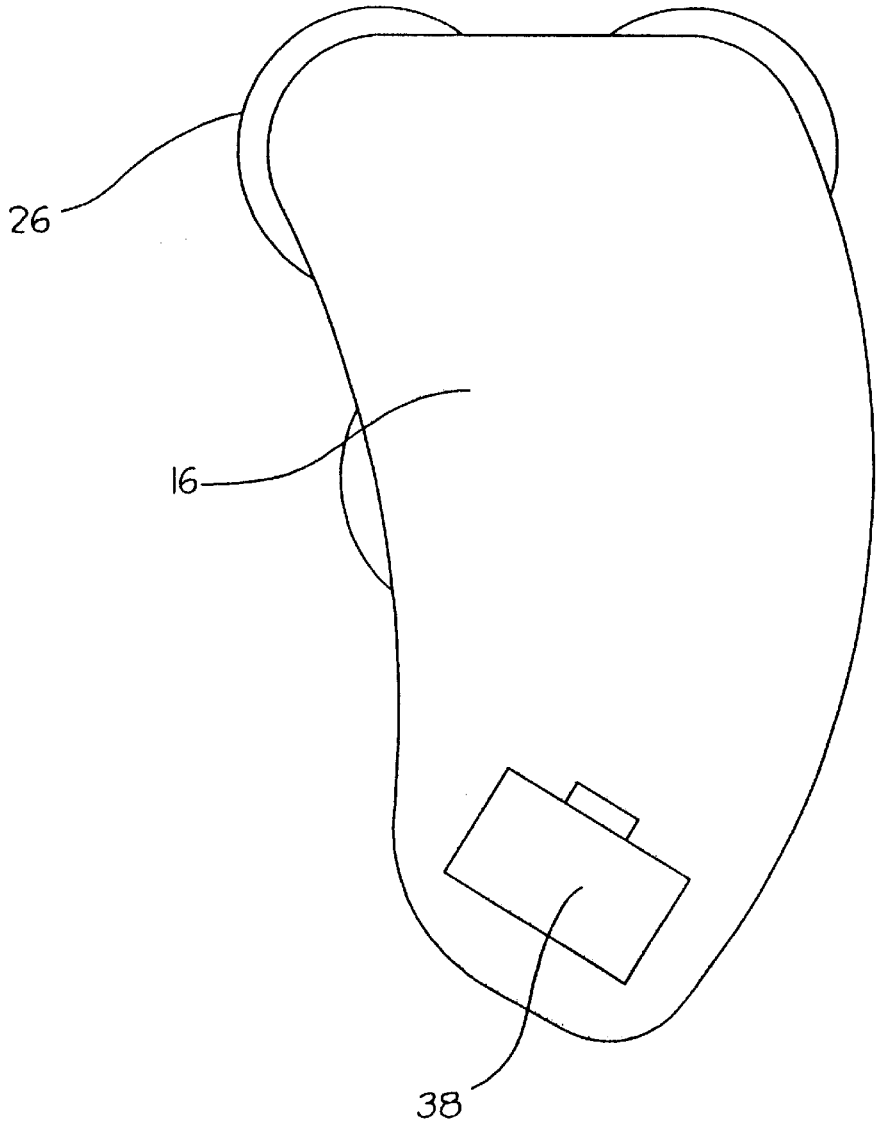
FIG. 4 is a rear elevation view of the present invention.
Figure 5:
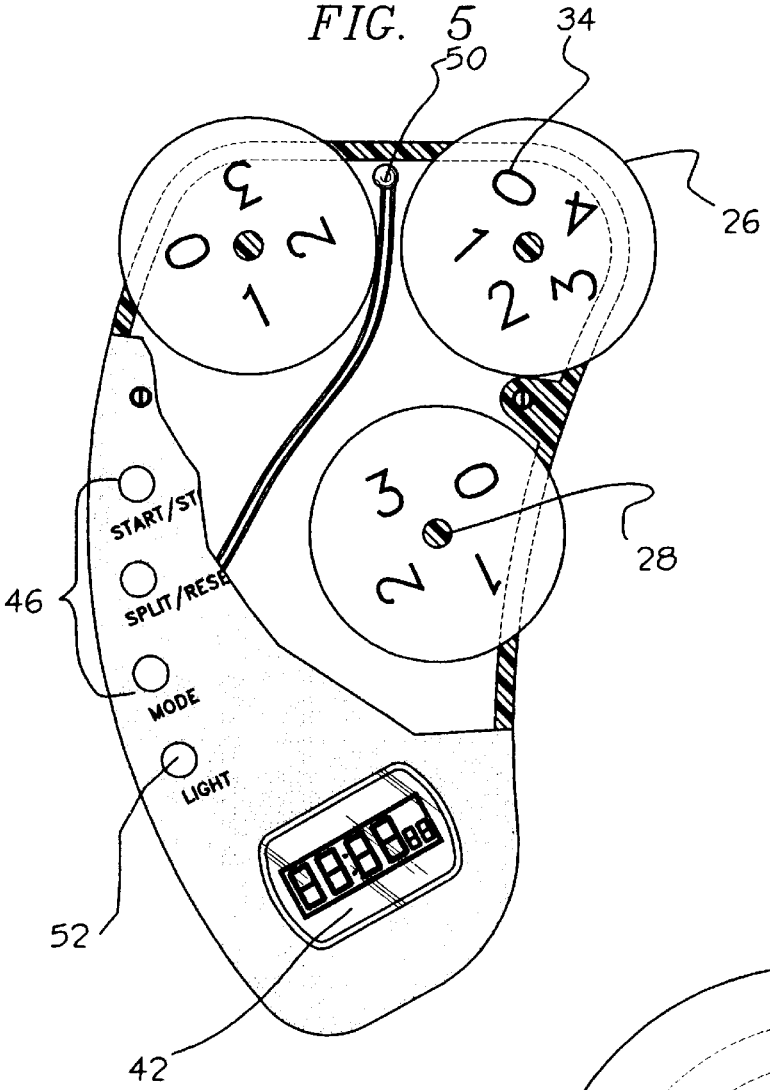
FIG. 5 is a front view of the present invention shown in partial cross-section.
Figure 6:
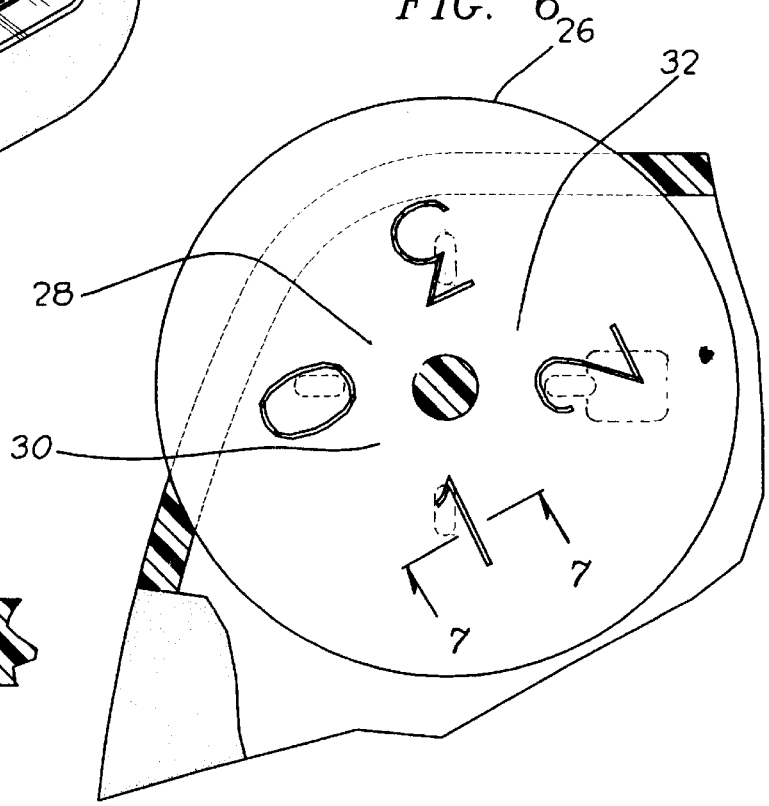
FIG. 6 is a fragmentary cross-sectional view of one of the wheels of the present invention.
Figure 7:
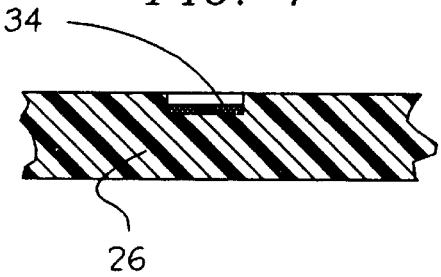
FIG. 7 is a cross-sectional view as taken along line 7—7 of FIG. 6.

With reference now to the drawings, and in particular, to FIGS. 1–7 thereof, the preferred embodiment of the new and improved illuminating umpire counter and timing device embodying the principles and concepts of the present invention and generally designated by the reference number 10 will be described.

Specifically, it will be noted in the various Figures that the device relates to a illuminating umpire counter and timing device for tracking pitches, outs and time during a ball game. In its broadest context, the device consists of a hand-held housing, three indicating wheels, a battery, an illuminating digital watch/stopwatch, a control panel and an LED. Such components are individually configured and correlated with respect to each other so as to attain the desired objective.

The device 10 includes a hand-held housing 12 having a top face 14, a bottom face 16 and a surrounding side wall 18. The housing 12 has a configuration dimensioned to fit in a palm of a hand. The top face 14 has three apertures 20 therethrough arranged in a triangular configuration. Each of the apertures 20 has distinguishable indicia 22 adjacent thereto. The indicia 22 includes an "S" next to one of the apertures to indicate strikes. A "B" next to one of the apertures indicates balls. An "O" next to the remaining aperture indicates outs. The housing 12 resembles a standard counter employed by umpires known in the art. The housing 12 is preferably constructed of an impact resistant material.

Three indicating wheels 26 are rotatably disposed and extend outwardly of the surrounding side wall 18 of the housing 12. The wheels 26 extend out of the housing so that a user can rotate the wheels 26 with their thumb or index finger. Each of the wheels 26 are rotatably coupled on a shaft 28. Each of the wheels 26 has a plurality of notches 30 disposed on a lower surface thereof. A spring plate 32 is disposed within the housing 12 for engagement with one of the plurality of notches 30. The spring plate 32 limits the rotation of the indicating wheels 26 so that only selected areas on the wheels 26 are visible through the apertures 20 of the housing 12. Two of the wheels 26 have illuminated numbers (0–3) 34 disposed circumferentially thereon. A last of the three wheels 26 has illuminated numbers (0–4) 34 disposed circumferentially thereon. The three wheels 26 are positioned within the housing 12 whereby the numbers 34 selectively align with the three apertures 20 of the housing 12. The two wheels 26 with the numbers (0–3) are positioned within the apertures 20 having the "S" and the "O". The wheel 26 with the (0–4) is positioned within the aperture with the "B". The user simply turns the wheels 26 to keep track of the number of balls, strikes, and outs during a baseball or softball game.

A battery (not shown) is disposed within the housing 12 inwardly of an access door 38 on the bottom face 16 of the housing 12. The access door 38 is adapted to be removed to replace the battery at a time when needed.

An illuminating digital watch/stopwatch 42 is secured within the top face 14 of the housing 12. The watch/stopwatch 42 is electrically coupled with the battery. The watch/stopwatch is provided with an illuminating feature so that the display can be easily viewed in dark conditions.

A control panel 46 is secured within the top face 14 of the housing 12. The control panel 46 has buttons 48 for controlling functions of the watch/stopwatch 42. The control panel 46 is electrically coupled with the battery. The control panel 46 includes buttons that will start and stop the stopwatch, split the display of the watch/stopwatch to show the watch and the stopwatch at the same time, and change modes between the watch and the stop watch.

Lastly, an LED 50 is secured within the top face 14 of the housing 12. The LED 50 is electrically coupled with a light button 52 of the control panel 46 whereby the light button 52 selectively activates or deactivates the LED 50. The user simply presses the LED to provide an added illuminating feature for use of the device 10 at night. Release of the light button 52 will deactivate the LED 50.

As to the manner of usage and operation of the present invention, the same should be apparent from the above description. Accordingly, no further discussion relating to the manner of usage and operation will be provided.

With respect to the above description then, it is to be realized that the optimum dimensional relationships for the parts of the invention, to include variations in size, materials, shape, form, function and the manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modification and changes will readily occur to those skilled in the art, it is not desired to limit the invention to the exact construction and operation shown and described, and accordingly, all suitable modification and equivalents may be resorted to, falling within the scope of the invention.

What is claimed as being new and desired to be protected by Letters Patent of the United States is as follows:

1. An illuminating umpire counter and timing device for tracking pitches, outs and time during a ball game comprising, in combination:

a hand-held housing having a top face, a bottom face and a surrounding side wall, the housing having a configuration dimensioned to fit in a palm of a hand, the top face having three apertures therethrough arranged in a triangular configuration, each of the apertures having distinguishable indicia adjacent thereto including an "S" to indicate strikes, a "B" to indicate balls, and an "O" to indicate outs;

three indicating wheels rotatably disposed and extending outwardly of the surrounding side wall of the housing, each of the wheels rotatably coupled on a shaft, each of the wheels having a plurality of notches disposed on a lower surface thereof, a spring plate disposed within the housing for engagement with one of the plurality of notches, two of the wheels having illuminated numbers 0–3 disposed circumferentially thereon, a last of the three wheels having illuminated numbers 0–4 disposed circumferentially thereon, the three wheels positioned within the housing whereby the numbers selectively aligning with the three apertures of the housing;

a battery disposed within the housing inwardly of an access door on the bottom face of the housing;

an illuminating digital watch/stopwatch secured within the top face of the housing, the watch/stopwatch being electrically coupled with the battery and having a watch function and a stopwatch function;

a control panel secured within the top face of the housing, the control panel having buttons for controlling functions of the watch/stopwatch, the control panel being electrically coupled with the battery, the control panel including a first button for starting the stopwatch function, a second button for stopping the stopwatch function, a third button for splitting the display to depict both the watch function and stopwatch function simultaneously and a fourth button for displaying only one of the stopwatch and watch functions; and an LED secured within the top face of the housing, the LED being electrically coupled with a light button of the control panel whereby the light button selectively activates or deactivates the LED, the LED being positioned between the rotating wheels for illuminating purposes.

* * * * *